US011845118B2

(12) United States Patent
Tezuka

(10) Patent No.: US 11,845,118 B2
(45) Date of Patent: Dec. 19, 2023

(54) CONTROL SYSTEM OF TANDEM COLD ROLLING MILL

(71) Applicant: Toshiba Mitsubishi-Electric Industrial Systems Corporation, Tokyo (JP)

(72) Inventor: Tomoyuki Tezuka, Tokyo (JP)

(73) Assignee: TOSHIBA MITSUBISHI-ELECTRIC INDUSTRIAL SYSTEMS CORPORATION, Tokyo (JP)

( * ) Notice: Subject to any disclaimer, the term of this patent is extended or adjusted under 35 U.S.C. 154(b) by 35 days.

(21) Appl. No.: 17/753,483

(22) PCT Filed: Sep. 4, 2020

(86) PCT No.: PCT/JP2020/033656
§ 371 (c)(1),
(2) Date: Mar. 4, 2022

(87) PCT Pub. No.: WO2022/049739
PCT Pub. Date: Mar. 10, 2022

(65) Prior Publication Data

US 2022/0288661 A1 Sep. 15, 2022

(51) Int. Cl.
*B21B 37/20* (2006.01)
*B21B 37/24* (2006.01)

(52) U.S. Cl.
CPC ..... *B21B 37/20* (2013.01); *B21B 37/24* (2013.01)

(58) Field of Classification Search
CPC ..... B21B 37/16; B21B 37/165; B21B 37/20; B21B 37/24; B21B 37/46; B21B 38/04; B21B 2261/04; B21B 2275/02; B21B 2275/04; B21B 2275/06
See application file for complete search history.

(56) References Cited

U.S. PATENT DOCUMENTS 5,495,735 A * 3/1996 Nishimura ..... B21B 37/16 72/11.8
8,516,869 B2 * 8/2013 Felkl ..... B21B 37/165 72/11.8
2019/0039107 A1 * 2/2019 Sieghart ..... B21B 31/16

FOREIGN PATENT DOCUMENTS

CN 102198452 A 9/2011
CN 106424156 A * 2/2017
EP 0 826 437 A1 3/1998
(Continued)

OTHER PUBLICATIONS

Translation JP 59-21423A, Sato et al. Feb. 1984.*
(Continued)

*Primary Examiner* — Edward T Tolan
(74) *Attorney, Agent, or Firm* — XSENSUS LLP

(57) ABSTRACT

In thickness control processing, transfer processing of an entry thickness He(N) is performed (step S1). In the transfer processing, data of the entry thickness He(N) is transferred from a position P11 to a position P12 at the same speed as the speed of a material to be rolled M. Subsequently, an amount of change in a thickness ΔH(N) is calculated (step S2). The amount of the change in the thickness ΔH(N) is calculated based on data of a delivery thickness Hd(N) and data of a transferred thickness Hc(N) transferred to the position P12 at a timing when the data of the delivery thickness Hd(N) is measured. Then, a target entry thickness He(N)_tgt is calculated (step S3). Subsequently, a manipulated amount of rolling speed VR(N−2) and VR(N−k) are calculated (step S4).

8 Claims, 5 Drawing Sheets

(56) References Cited

FOREIGN PATENT DOCUMENTS

| | | | | |
|---|---|---|---|---|
| JP | 59-21423 | A | * | 2/1984 |
| JP | 7-68305 | A | | 3/1995 |
| JP | 9-253721 | A | | 9/1997 |
| JP | 11-342409 | A | | 12/1999 |
| JP | 2018-5544 | A | * | 1/2018 |
| JP | 2018-99707 | A | | 6/2018 |
| JP | 2018-122339 | A | | 8/2018 |

OTHER PUBLICATIONS

Indian Office Action dated Apr. 18, 2023, in corresponding Indian Patent Application 202217012912, 6pp.
International Search Report and Written Opinion dated Nov. 17, 2020, received for PCT Application PCT/JP2020/033656, Filed on Sep. 4, 2020, 8 pages.

* cited by examiner

CONTROL SYSTEM OF TANDEM COLD ROLLING MILL

CROSS-REFERENCE TO RELATED APPLICATION

The present application is based on PCT filing PCT/JP2020/033656, filed Sep. 4, 2020, the entire contents of which is incorporated herein by reference.

TECHNICAL FIELD

The present invention relates to a control system of a tandem cold rolling mill in which a light reduction rolling of a final stand is performed.

BACKGROUND

A cold rolling is known in which a material such as metal (hereinafter referred to as a "material to be rolled") is continuously rolled by a plurality of stands. In a typical cold rolling, thickness control and tension control are executed. In the thickness control, a delivery thickness of stands located in the second and the downstream is controlled by rolling speed of a stand located upstream of the said stands. In the tension control, an entry tension of the stand is controlled by a roll gap of the said stand.

There is also known the cold rolling in which a roll having a large surface roughness (hereinafter referred to as a "dull roll") is used at a final stand, and an appropriate roughness is imparted to a surface of the material to be rolled for a downstream-line process. In the cold rolling using the dull roll, in order to make a transfer of the surface roughness uniform, constant force control is usually executed to control a rolling force of the final stand to a predetermined value or a value within a permissible range. In this case, the roll gap of the final stand is used for the constant force control, while the entry tension of the final stand is controlled by rolling speed of a stand located upstream of the final stand. That is, the thickness control of the final stand is executed by rolling speed of the stand located two stands upstream of the final stand. Therefore, there was a problem that lag time was large and it was difficult to control a delivery thickness of the final stand with high accuracy.

Examples of prior arts for solving this problem include those disclosed in PLS 1 and 2. In these prior arts, first and second thickness controls are executed such that an entry thickness of the final stand (i.e., a delivery thickness of the stand located one stand upstream of the final stand) becomes to a target value thereof. In the first thickness control, the rolling speed of the stand located two or more stands upstream of the final stand is controlled based on a deviation between the delivery thickness of the stand located one stand upstream of the final stand and the target value thereof. In the second thickness control, the target value of the delivery thickness used in the first thickness control is modified based on the deviation between the delivery thickness of the final stand and the target value thereof.

In the prior art disclosed in PL3, the delivery thickness of the final stand is controlled without measuring the delivery thickness of the final stand. In this prior art, the target value of the delivery thickness of a stand located one stand upstream of the final stand is calculated by using a preset target value of the delivery thickness of the final stand and a preset reduction rate of the final stand. Then, the rolling speed of the stand located two or more stands upstream of the final stand is controlled such that the delivery thickness of the stand becomes to the calculated target value.

CITATION LIST

Patent Literature

[PL1] JPH7-68305A
[PL2] JPH11-342409A
[PL3] JP2018-122339A

SUMMARY

Technical Problem

However, in the thickness control disclosed in PL1 or 2, the modification of the target value of the delivery thickness used in the first thickness control is performed by inputting the deviation of the delivery thickness at the final stand to a proportional integrator or the like. Therefore, there is a problem that a delay due to this modification of the target value occurs.

Also, the fact that the deviation of the delivery thickness is inputted in the final stand means that a current situation of the entry thickness of final stand (i.e. the current situation of the delivery thickness of the stand located one stand upstream of the final stand) is not taken into account in the modification of the target value. Therefore, there are the following problems. That is, the modification of the target value functions well while the delivery thickness of the stand located one stand upstream of the final stand changes near the target value. Otherwise, an effect of the deviation of the delivery thickness on this stand affects the delivery thickness of the final stand, and it takes time for the modification of the target value to settle down. This is particularly pronounced at a start of the rolling or at a flying thickness change.

The thickness control of PL3 has the following problems. That is, the reduction rate of the final stand varies depending on rolling conditions such as tension, rolling force, and friction coefficients between the roll and the material to be rolled. However, in the thickness control of PL3, the target value of the delivery thickness of the stand located one stand upstream of the final stand is calculated by using the preset reduction rate. In addition, feedback control based on a measured value of the delivery thickness of the final stand is not executed. Therefore, if the preset reduction rate is not appropriate, it is difficult to bring the delivery thickness of the final stand close to the target value thereof.

The present invention has been made to solve at least one of the above-described problems. It is an object of the present invention to provide a technique capable of enhancing control response of the thickness control in the cold rolling where the light reduction rolling is executed in the final stand.

Means for Solving the Problems

The present invention is a control system of a tandem cold rolling mill that comprises at least three or more stands in which a light reduction rolling is performed in a final stand of the at least three or more stands. The present invention has the following features.

The control system includes an entry thickness gauge, a delivery thickness gauge, and a control device.

The entry thickness gauge measures an entry thickness indicating a thickness of a material to be rolled in an entry side of the final stand.

The delivery thickness gauge measures a delivery thickness indicating a thickness in a delivery side of the final stand.

The control device executes thickness control of the material to be rolled by the at least three or more stands.

In the thickness control, the control device is configured to:

based on entry speed indicating speed of the material to be rolled in the entry side of the final stand and delivery speed indicating the speed in the delivery side of the final stand, transfer the measured data of the entry thickness from an installation location of the entry thickness gauge to the installation location of the delivery thickness gauge at the same speed as speed of the material to be rolled;

based on the measured data of the delivery thickness and transfer data indicating the measured data of the entry thickness that is transferred to the installation location of the delivery thickness gauge at a timing when the said measured data of the delivery thickness is measured, calculate an amount of change in a thickness in the final stand;

based on the amount of change in the thickness and a target delivery thickness indicating a target value of the thickness in the delivery side of the final stand, calculate a target entry thickness indicating a target value of the thickness in the entry side of the final stand; and calculate a manipulated amount of rolling speed of a stand located two or more stands upstream of the final stand such that the measured data of the entry thickness coincides with the target entry thickness.

The control system may include an entry speed meter and a delivery speed meter.

The entry speed meter is provided in the entry side of the final stand and measures the entry speed.

The delivery speed meter is provided in the delivery side of the final stand and measures the delivery speed.

The control system may include an entry roll, an entry rotational speed meter, a delivery roll, and a delivery rotational speed meter.

The entry roll is a non-rolling roll installed in the entry side of the final stand.

The entry rotational speed meter detects rotational speed of the entry roll.

The delivery roll is the non-rolling roll installed in the delivery side of the final stand.

The delivery rotational speed meter detects the rotational speed of the delivery roll.

In the thickness control, the control device may be configured to:

estimate the entry speed based on the rotational speed and a roll diameter of the entry roll; and estimate the delivery speed based on the rotational speed and the roll diameter of the delivery roll.

In the thickness control, the control device may be configured to:

estimate the entry speed based on the rolling speed of a stand located one stand upstream of the final stand and a forward slip of the said stand; and estimate the delivery speed based on the rolling speed and the forward slip of the final stand.

In the thickness control, the control device may be configured to:

calculate the amount of the change in the thickness based on a ratio obtained by dividing the transfer data by the measured data of the delivery thickness or a difference obtained by subtracting the measured data of the delivery thickness from the transfer data.

Effects of Invention

According to the present invention, the measured data of the thickness (the entry thickness) of the material to be rolled in the entry side of the final stand is transferred from the installation location of the entry thickness gauge to the installation location of the delivery thickness gauge at the same speed as the speed of the material to be rolled. Therefore, it is possible to calculate the amount of the change in the thickness in the final stand immediately after obtaining the measured data of the thickness (the delivery thickness) of the material to be rolled in the delivery side of the final stand. This amount of the change in the thickness is calculated based on the measured data of the delivery thickness and the measured data of the entry thickness (the transfer data) that is transferred to the installation location of the delivery thickness gauge at the timing when the measured data of the delivery thickness is obtained. Therefore, the amount of the change in the thickness data accurately represents a reduction in the final stand.

According to the present invention, the target value (the target entry thickness) of the thickness of the material to be rolled in the entry side of the final stand is calculated based on the data of this amount of the change in thickness, and further, the manipulated amount of the rolling speed of the stand located two or more stands upstream of the final stand is calculated such that the measured data of the entry thickness coincide with this target entry thickness. Here, the entry thickness is synonymous with the thickness of the material to be rolled in stand located one stand upstream of the final stand, and the target entry thickness is synonymous with the target value of the thickness of the material to be rolled in the said stand (i.e., the stand located one stand upstream of the final stand). Therefore, according to the present invention, regardless of the thickness of the material to be rolled in the stand located one stand upstream of the final stand, it is possible to match the delivery thickness (i.e., the thickness of the material to be rolled in the delivery side of the final stand) quickly to the target delivery thickness (i.e., the target value of the thickness in the delivery side of the final stand). That is, it is possible to enhance control response of the thickness control.

DESCRIPTION OF EMBODIMENTS

Figure 1:
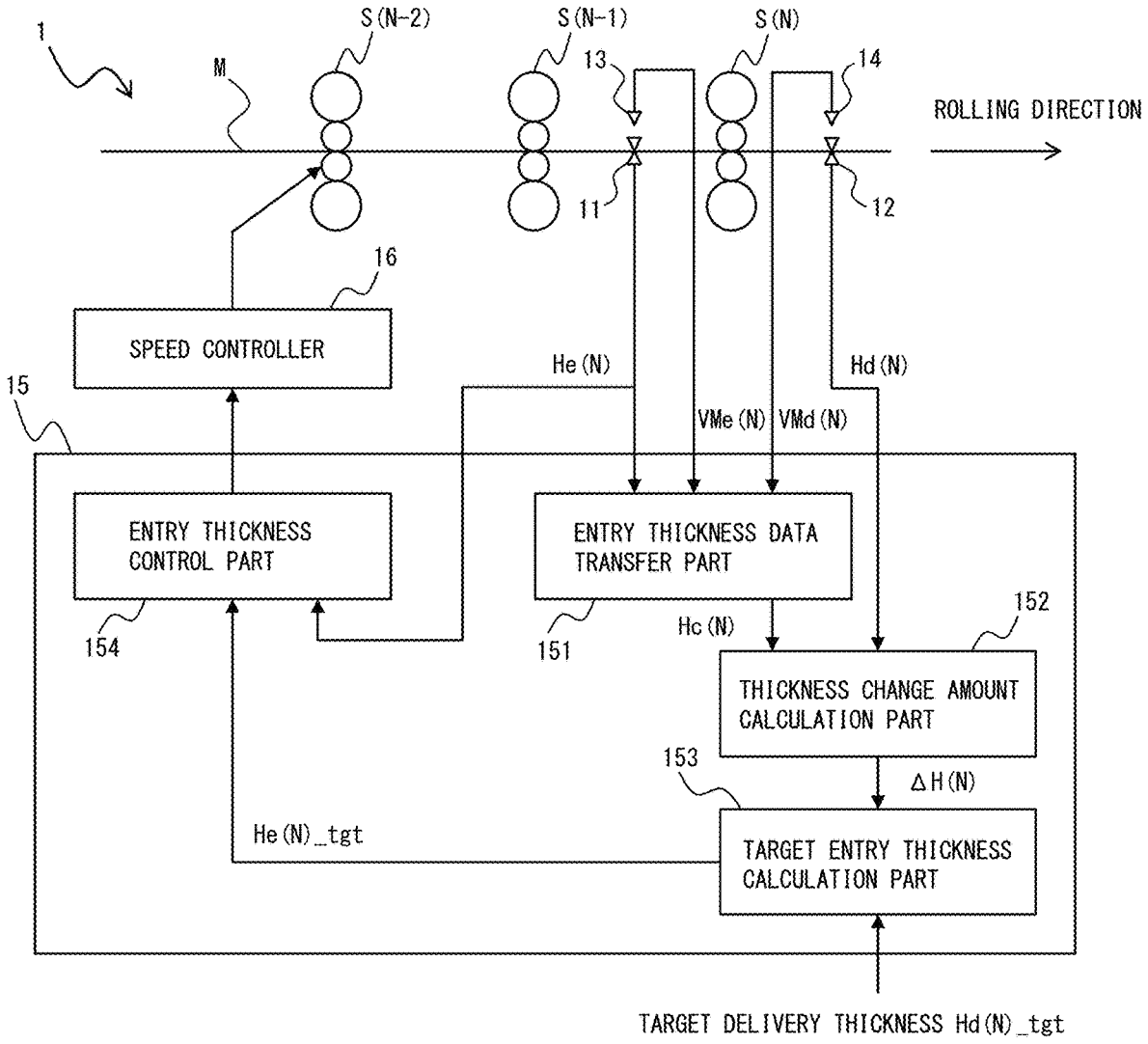
FIG. 1 is a diagram illustrating an example of an entire configuration of a tandem cold rolling mill to which a control system according to a first embodiment is applied.

Hereinafter, embodiments of the present invention will be described in detail with reference to drawings. Note that elements common to each drawing are designated by the same reference numerals, and duplicate description will be omitted.

1. First Embodiment

First, a control system of a tandem cold rolling mill according to a first embodiment of the present invention will be described with reference to FIGS. 1 to 3.

1-1. Configuration Example of Control System

Figure 2:
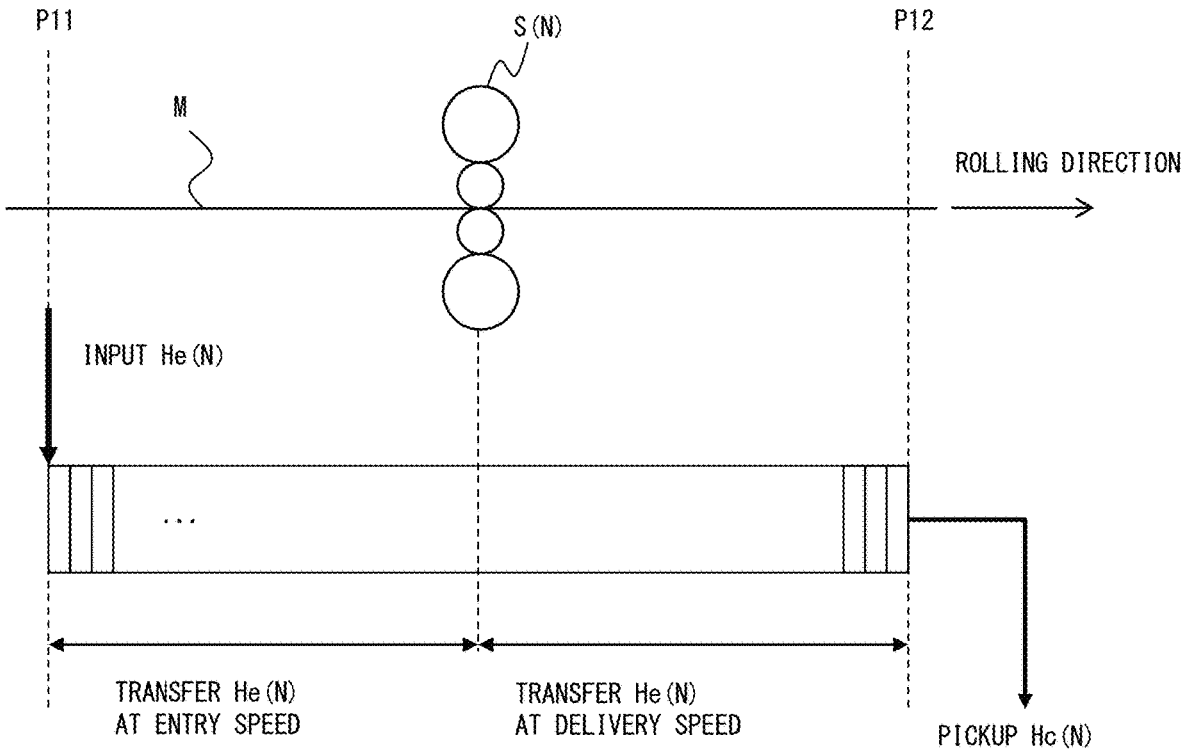
FIG. 2 is a diagram illustrating an example of transfer processing executed by an entry thickness data transfer part.

FIG. 1 is a diagram illustrating an example of an entire configuration of a tandem cold rolling mill to which the control system according to the first embodiment is applied. A tandem cold rolling mill (hereinafter, simply referred to as a "rolling mill") 1 shown in FIG. 1 comprises at least three stands (e.g., 5-6 stands). Although a four high rolling mill is schematically shown in FIG. 1, the stand may be composed of other rolling mill such as a six high rolling mill. A stand S(N) is a stand, included in the at least three stands, which locates most downstream in the rolling direction (i.e., a final stand) (N denotes total number of the stands). A stand S(N−1) is a stand located one stand upstream of the final stand. A stand S(N−2) is a stand located two stands upstream of the final stand.

In an entry side of the stand S(N), a thickness gauge 11 is provided. The thickness gauge 11 measures a thickness of the material to be rolled M in the entry side of stand S(N) (hereinafter also referred to as "entry thickness") He(N). In a delivery side of the stand S(N), a thickness gauge 12 is provided. The thickness gauge 12 measures the thickness of material to be rolled M in the delivery side of the stand S(N) (hereinafter also referred to as a "delivery thickness") Hd(N).

A speed meter 13 is provided in the entry side of the stand S(N). The speed meter13 measures speed of the material to be rolled M in the entry side of stand S (N) (hereinafter also referred to as "entry speed") VMe(N). A speed meter 14 is provided in the delivery side of the stand S(N). The speed meterl4 measures the speed of the material to be rolled M in the delivery side of the stand S(N) (hereinafter also referred to as "delivery speed") VMd(N).

The rolling mill 1 comprises a control device 15. The control device 15 typically consists of a computer with a processor, a memory and an input/output interface. The control device 15 is connected to a host computer that determines rolling-related preset data such as a product thickness or the like. The configuration of the host computer may be included in the control device 15. The control device 15 constitutes a part of a tension control system, a constant force control system and a thickness control system.

In a case where the control device 15 constitutes a part of the tension control system, the control device 15 controls a tension between the stand S(N−1) and the stand S(N) by manipulating rolling speed of the stand S(N−1) based on preset data (e.g., target tension data) from the host computer and measured data (e.g., actual tension data) from the rolling mill 1. The control device 15 also controls the tension between the stand S(N—2) and the stand S(N−1) by manipulating a roll gap of the stand S(N−1) based on the preset data (e.g., the target tension data) and the measured data (e.g., the actual tension data). In another example of the tension control system, the control device 15 controls the tension between the stand S(N−1) and the stand S(N) by the roll gap of the stand S(N).

In a case where the control device 15 constitutes a part of the constant force control system, the control device 15 operates a "light reduction rolling" that constantly controls a rolling force of the stand S(N) by manipulating a roll gap of the stand S(N). For example, the control device 15 manipulates the roll gap of the stand S(N) such that measured data (e.g., actual rolling force data) in the stand S(N) matches the preset data (e.g., target rolling force data).

FIG. 1 illustrates a configuration example in which the control device 15 constitutes a part of the thickness control system. In a case where the control device 15 constitutes a part of the thickness control system, the control device 15 acquires the measured data and the preset data. The measured data includes data of the entry thickness He(N), the delivery thickness Hd(N), the entry speed VMe(N) and the delivery speed VMd(N). The preset data includes data of a target delivery thickness Hd(N)_tgt. The target delivery thickness Hd(N)_tgt indicates a target value of the thickness of the material to be rolled M in the delivery side of the stand S(N).

The control device 15 manipulates the rolling speed of the stand S(N−2) such that the entry thickness He(N) matches the target entry thickness He(N)_tgt. The target entry thickness He(N)_tgt indicates the target value of the thickness of the material to be rolled M in the entry side of stand S(N). As a functional configuration when constituting a part of the thickness control system, the control device 15 includes an entry thickness data transfer part 151, a thickness change amount calculation part 152, a target entry thickness calculation part 153, and an entry thickness control part 154. These functions are realized when the processor of the control device 15 executes predetermined programs stored in the memory.

The entry thickness data transfer part 151 executes transfer processing of data of the entry thickness He(N). In the transfer processing, the data of the entry thickness He(N) is transferred from an installation location of the thickness gauge 11 to that of the thickness gauge 12. FIG. 2 is a diagram illustrating an example of transfer processing executed by the entry thickness data transfer part 151. Roughness is imparted to the material to be rolled M shown in FIG. 2 by a light reduction rolling of the stand S(N). A position P11 represents the installation location of the thickness gauge 11. A position P12 represents the installation location of the thickness gauge 12.

In the transfer processing, the data of the entry thickness He(N) acquired by the thickness gauge 11 is transferred from the position P11 to the position P12 at the same speed as the speed of the material to be rolled M. The transfer speed of the data of the entry side of stand S(N) is equal to entry speed, and that in the delivery side of stand S(N) is equal to delivery speed.

The transfer of the data is performed as follows, for example. First, an entry side section from the position P11 to stand S(N) and a delivery side section from stand S(N) to the position P12 are finely divided. A transfer distance of the material to be rolled M is calculated each scanning time, and the data of the entry thickness He(N) is transferred based on the calculated transfer distance.

In another transfer example, a combination of data area and transfer distance area is set. The data of the entry thickness He(N) is stored in the data area. Then, based on the entry speed and the delivery speed, a transfer amount of the material to be rolled M from a timing when the data of the entry thickness He(N) is inputted is calculated and the transfer distance area is updated. When this transfer distance area reaches the distance from the position P11 to the position P12, the data of the entry thickness He(N) is extracted from the data area.

When the transfer processing is executed, the data of the entry thickness He(N) is transferred from the position P11 to the position P12 at the same speed as the speed of the material to be rolled M. The entry thickness data transfer part 151 transmits the data of the entry thickness He(N) that is transferred to the position P12 at the timing when the data of the delivery thickness Hd(N) is measured to the thickness change amount calculation part 152 as the "data of the transferred thickness Hc(N)".

The thickness change amount calculation part 152 calculates an amount of change in the thickness ΔH(N) of the material to be rolled M in the stand S(N). The amount of the change in the thickness ΔH(N) is calculated based on the data of the delivery thickness Hd(N) and the data of the transferred thickness Hc (N) transferred to the position P12 at the timing when the data of the delivery thickness Hd (N) is measured. The amount of the change in the thickness ΔH(N) is, for example, a ratio ΔHR(=Hc(N)/Hd(N)) obtained by dividing the data of the transferred thickness Hc(N) by the data of the delivery thickness Hd(N). In another example, the amount of the change in the thickness ΔH(N) is a difference ΔHD(=Hc(N)−Hd(N)) obtained by subtracting the data of the delivery thickness Hd(N) from the data of the transferred thickness Hc(N). The thickness change amount calculation part 152 transmits the amount of the change in the thickness ΔH(N) to the target entry thickness calculation part 153.

The target entry thickness calculation part 153 calculates the target entry thickness He(N)_tgt based on the target delivery thickness Hd(N)_tgt and the amount of the change in the thickness ΔH(N). In a case where the amount of the change in the thickness ΔH(N) is the ratio ΔHR, the target entry thickness calculation part 153 calculates the target entry thickness He(N)_tgt by using the following relationship (2). In a case where the amount of the change in the thickness ΔH(N) is the difference ΔHD, the target entry thickness calculation part 153 calculates the target entry thickness He(N)_tgt by using the following relationship (3).

$$He(N)_tgt = Hd(N)_tgt \times \Delta HR \quad (2)$$

$$He(N)_tgt = Hd(N)_tgt + \Delta HD \quad (3)$$

The target entry thickness calculation part 153 transmits the data of the target entry thickness He(N)_tgt to the entry thickness control part 154.

The entry thickness control part 154 calculates a manipulated amount of a rolling speed VR(N−2) of the stand S(N−2) based on a deviation ΔHe(N) between the target entry thickness He(N)_tgt and the entry thickness He(N). Here, the entry side of the stand S(N) has the same meaning as the delivery side of the stand S(N−1). Thus, the entry thickness He(N) is synonymous with the thickness of the material to be rolled M in the delivery side of the stand S(N−1) (i.e., the delivery thickness Hd(N−1)). Also, the target entry thickness He(N)_tgt is synonymous with the target value of the thickness of the material to be rolled M in the delivery side of the stand S(N−1) (i.e., the target delivery thickness Hd(N−1)_tgt).

Examples of a method for calculating the manipulated amount of the rolling speed VR(N−2) include a known proportional-integral control. In order to improve control response, a Smith compensator may be added to the configuration of the feedback control system. Note that any method for calculating the manipulated amount of the rolling speed VR(N−2) that is able to quickly reduce the entry thickness deviation ΔHe(N) can be applied without being limited to the above-described calculation method. The entry thickness control part 154 outputs the data of the manipulated amount of the rolling speed VR(N−2) to the speed controller 16.

The entry thickness control part 154 also calculates the manipulated amount of the rolling speed VR(N−k) of the stand S(N−k) (where 3≤k<N−1). That is, the entry thickness control part 154 calculates the manipulated amount of the rolling speed of a stand located two or more stands upstream of the stand S(N). To stabilize the operation of the rolling mill 1, the manipulated amount of the rolling speed VR(N−k) is set at the same rate as the manipulated amount of the rolling speed VR(N−2). The manipulated amount of the rolling speed VR(N−k) may be set to a predetermined rate.

1-2. Example of Thickness Control by Control Device

Figure 3:
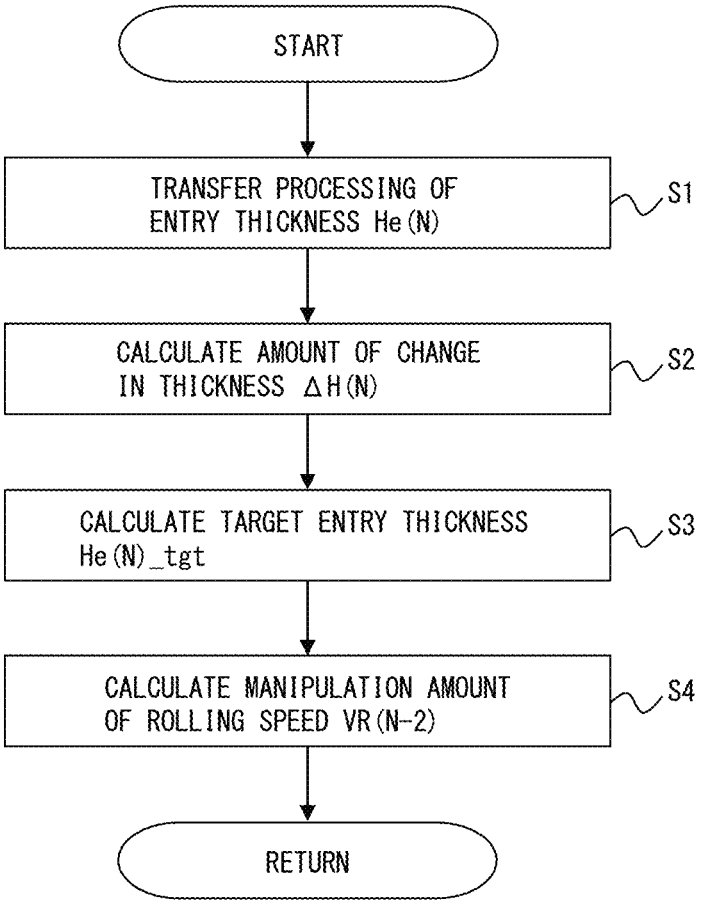
FIG. 3 is a flow chart showing a flow of thickness control processing executed by a control device.

FIG. 3 is a flow chart showing a flow of thickness control processing executed by the control device 15 (the processor). In the example shown in FIG. 3, first, transfer processing of the entry thickness He(N) is executed (step S1). The transfer processing is executed each time at which the entry thickness He(N) is measured by the thickness gauge 11. In the transfer processing, the data of the entry thickness He(N) measured by the thickness gauge 11 is transferred from the position P11 to the position P12 at the same speed as the speed of the material to be rolled M.

Subsequent to the step S1, the amount of the change in the thickness ΔH(N) is calculated (step S2). The calculation of the amount of the change in the thickness ΔH(N) is performed each time at which the delivery thickness Hd(N) is measured by the thickness gauge 12. The amount of the change in the thickness ΔH(N) is calculated based on the data of the delivery thickness Hd(N) and the data of the transferred thickness Hc(N) transferred to the position P12 at the timing when the data of the delivery thickness Hd(N) is measured. The amount of the change in the thickness ΔH(N) is obtained as the ratio ΔHR or the difference ΔHD.

Subsequent to the step S2, the target entry thickness He(N)_tgt is calculated (step S3). The target entry thickness He(N)_tgt is calculated based on the data of the amount of the change in the thickness ΔH(N) that is calculated in the step S2 and the data of the target delivery thickness Hd(N)_tgt. As explained above, the data of the target delivery thickness Hd(N)_tgt is included in the preset data from the host computer.

Subsequent to the step S3, the manipulated amount of the rolling speed VR(N−2) and VR(N−k) is calculated (step S4). The manipulated amount of the rolling speed VR(N−2) is calculated based on the entry thickness deviation ΔHe(N) between the data of the target entry thickness He(N)_tgt that is calculated in the step S3 and most recent data of the entry thickness He(N) (i.e., the delivery thickness Hd(N−1)) measured by the thickness gauge 11. The manipulated amount of the rolling speed VR(N−k) is set to the same ratio as the manipulated amount of the rolling speed VR(N−2) or a predetermined ratio.

1-3. Effect

According to the first embodiment described above, since the transfer processing of the data of the entry thickness He(N) is performed, it is possible to calculate the amount of the change in the thickness ΔH(N) immediately after the data of the delivery thickness Hd(N) is measured. Further, the calculation of the amount of the change in the thickness ΔH(N) is performed based on the data of the delivery thickness Hd(N) and the data of the transferred thickness Hc(N) transferred to the position P12 at the timing when the data of the delivery thickness Hd(N) is measured. Therefore, the data of the amount of the change in the thickness ΔH(N) accurately represents the reduction state in the stand S(N).

Then, according to the first embodiment, the target entry thickness He(N)_tgt (i.e., the target delivery thickness Hd(N−1)_tgt) is calculated based on the data of the amount of the change in the thickness ΔH(N), further, the manipulated amount of the rolling speed of the stand located two or more stands upstream from the stand S(N) is calculated. Therefore, regardless of the delivery thickness Hd(N−1), the delivery thickness Hd(N−1) can be quickly matched to the target delivery thickness Hd(N−1)_tgt. That is, it is possible to enhance control response of the thickness control. It is also possible to achieve the target delivery thickness Hd(N)_tgt in the delivery side of the stand S(N).

2. Second Embodiment

Next, a control system according to a second embodiment of the present invention will be described with reference to FIG. 4. Note that descriptions overlapping with the descriptions in the first embodiment are omitted as appropriate.

2-1. Configuration Example of Control System

Figure 4:
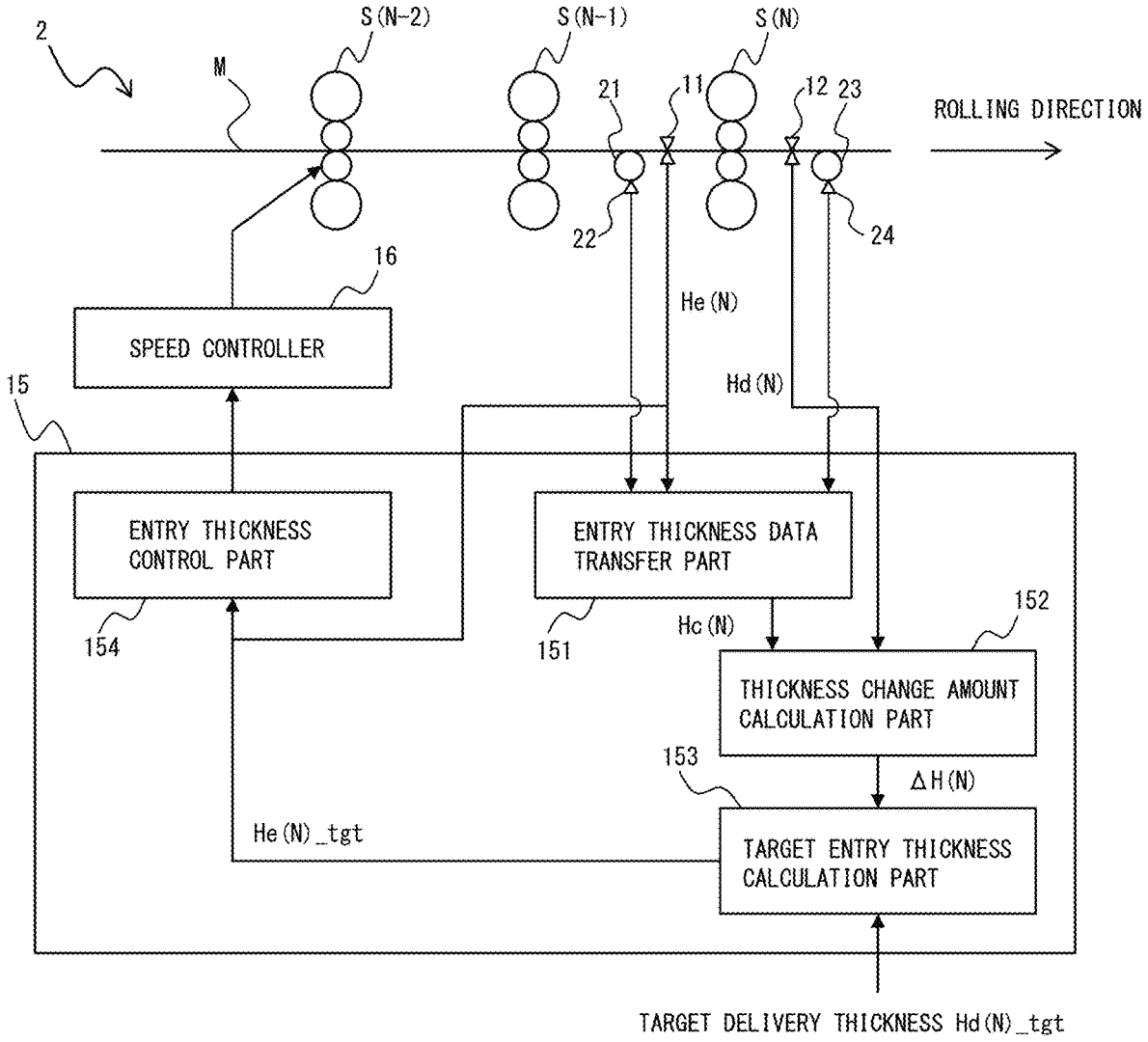
FIG. 4 is a diagram illustrating an example of an entire configuration of a tandem cold rolling mill to which a control system according to a second embodiment is applied.

FIG. 4 is a diagram illustrating an example of an entire configuration of a tandem cold rolling mill to which the control system according to the second embodiment is applied. The rolling mill 2 shown in FIG. 4 is provided with a tension meter roll 21 in the entry side of stand S(N). A tension between the stand S(N−1) and the stand S(N) is measured, a force from the material to be rolled M being applied to a tension meter that is installed under the tension meter roll 21 via the tension meter roll 21. The tension meter roll 21 is equipped with a pulse detector 22 for detecting its rotational speed. The tension meter roll 21 corresponds to an "entry roll" in the present application. The pulse detector 22 corresponds to an "entry rotational speed meter" in the present application.

The rolling mill 2 has a shape meter roll 23 in the delivery side of the stand S(N). The shape meter roll 23 measures a shape (e.g., a flatness) of the material to be rolled M in the delivery side of the stand S(N). The shape meter roll 23 is equipped with a pulse detector 24 for detecting its rotational speed. The shape meter roll 23 corresponds to a "delivery roll" in the present application. The pulse detector 24 corresponds to a "delivery rotational speed meter" in the present application.

In the first embodiment, the measured data of the speed meters 13 and 14 (i.e., the data of the entry speed VMe(N) and the delivery speed VMd(N)) were used to transfer the data of the entry thickness He(N). On the other hand, in the second embodiment, the entry speed VMe(N) is calculated based on the rotational speed of the tension meter roll 21 and the roll diameter (known), and the delivery speed VMd(N) is calculated based on the rotational speed of the shape meter roll 23 and the roll diameter (known). That is, in the second embodiment, the data of the entry thickness He(N) is transferred based on the estimated values of the entry speed VMe(N) and the delivery speed VMd(N).

In the second embodiment, another tension meter roll different from the tension meter roll 21 may be provided in the delivery side of stand S(N). In this case, the delivery speed VMd(N) may be estimated based on the rotational speed and the roll diameter of the another tension meter roll. In this case, the another tension meter roll corresponds to the "delivery roll" in the present application. If a tension reel to wind the material to be rolled M as a coil is provided in the delivery side of stand S(N), the delivery speed VMd(N) may be estimated based on the rotational speed of the coil (winding speed) and the coil diameter that is calculated separately.

In the second embodiment, the entry side of the stand S(N) may be provided with another shape meter roll different from the shape meter roll 23. In this case, the entry speed VMe(N) may be estimated based on the rotational speed and the roll diameter of the another shape meter roll. In this case, the another shape meter roll corresponds to the "entry roll" in the present application.

In addition, in the second embodiment, the data of the entry thickness He(N) may be transferred based on a combination of the estimated data of the delivery speed VMd(N) and the measured data of the speed meter13 (i.e., the entry speed VMe(N)). The data of the entry thickness He(N) may be transferred based on the combination of the estimated data of the entry speed VMe(N) and the measured data of the speed meter 14 (i.e., the delivery speed VMd(N)).

2-2. Effect

According to the second embodiment described above, the same effect as the effect of the first embodiment can be obtained.

3. Third Embodiment

Next, a control system according to a third embodiment of the present invention will be described with reference to FIG. 5. Note that descriptions overlapping with the descriptions in the first embodiment are omitted as appropriate.

3-1. Configuration Example of Control System

Figure 5:
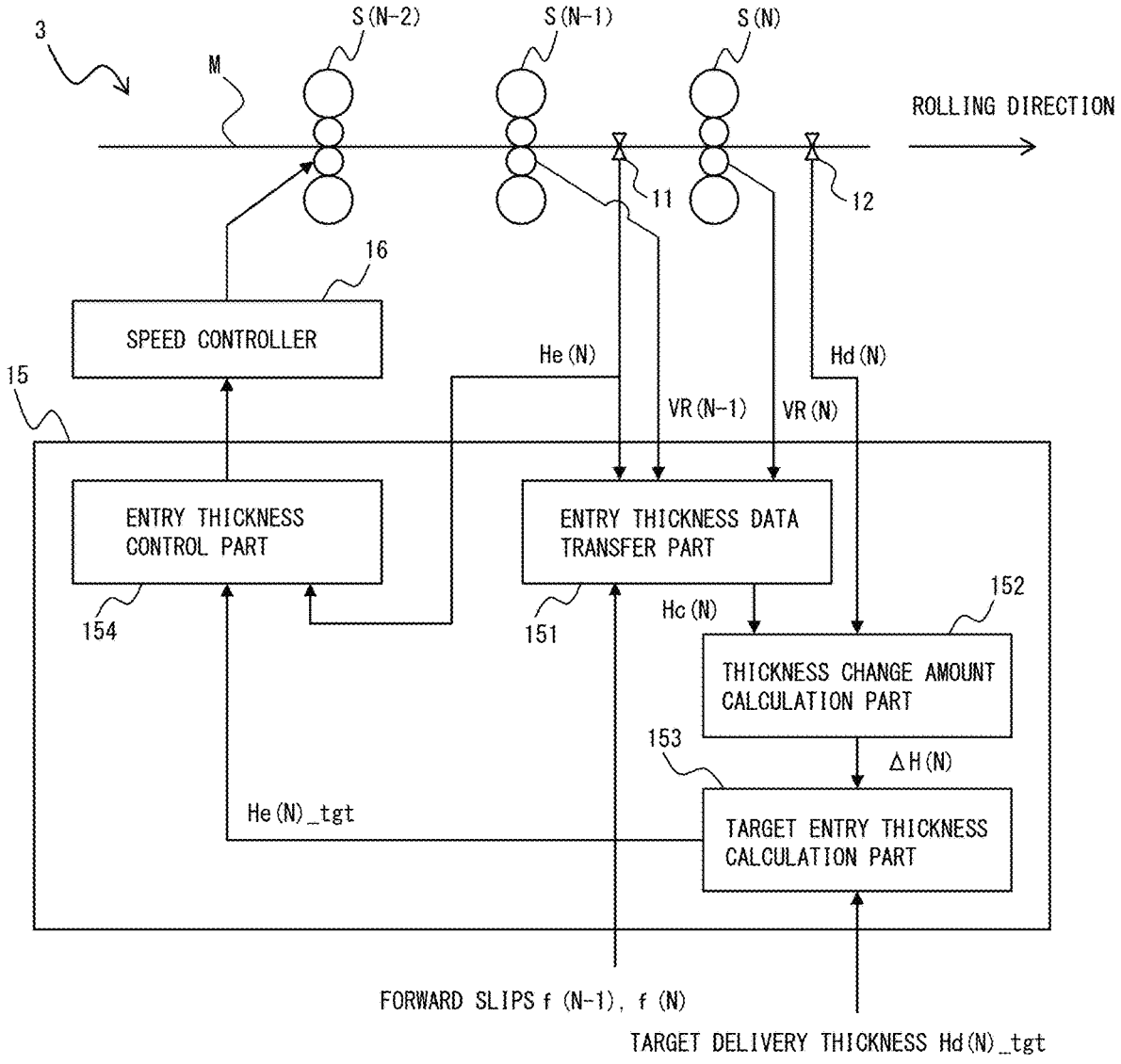
FIG. 5 is a diagram illustrating an example of an entire configuration of a tandem cold rolling mill to which a control system according to a third embodiment is applied.

FIG. 5 is a diagram illustrating an example of an entire configuration of a tandem cold rolling mill to which the control system according to the third embodiment is applied. The rolling mill 3 shown in FIG. 5, rolling speed VR(N−1) and VR(N) are inputted to the control device 15. The rolling speed VR(N−1) is the rolling speed of the stand S(N−1). The rolling speed VR(N) is the rolling speed of stand S(N).

In addition, forward slips f(N−1) and f(N) are inputted to the control device 15 as the preset data from the host computer. Here, the forward slip f(m) is calculated from the following relationship (4) (where m=N−1 or N).

$$f(m)=\{VMd(m)-VR(m)\}/VR(m) \quad (4)$$

Therefore, if the forward slip f(N−1) and rolling speed VR(N−1) are substituted into the relationship (4), the delivery speed VMd(N−1) (i.e., the entry speed VMe(N)) is calculated. If the forward slip f(N) and rolling speed VR(N) are substituted into the relationship (4), the delivery speed VMd(N) is calculated.

In the first embodiment, the measured data of the speed meters 13 and 14 (i.e., the data of the entry speed VMe(N) and the delivery speed VMd(N)) were used to transfer the data of the entry thickness He(N). On the other hand, in the third embodiment, the data of the entry thickness He(N) is transferred based on estimated values of the entry speed VMe(N) and the delivery speed VMd(N).

In the third embodiment, the data of the entry thickness He(N) may be transferred based on the combination of the estimated data of the delivery speed VMd(N) and the measured data of the speed meter 13 (i.e., the entry speed VMe(N)). The data of the entry thickness He(N) may be transferred based on the combination of the estimated data of the entry speed VMe(N) and the measured data of the speed meter 14 (i.e., the delivery speed VMd(N)).

3-2. Effect

According to the third embodiment described above, the same effect as the effect of the first embodiment can be obtained.

4. Other Embodiment

In the first to the third embodiments, the roll gap of the stand S(N) was used for the constant force control and the rolling speed VR(N−1) was used for the tension control. However, the present invention can be widely applied to a control system where the delivery thickness Hd(N) cannot be directly controlled, such as when a constant roll gap control for controlling roll gap of stand S(N) to a predetermined position is performed.

REFERENCE SIGNS LIST

1, 2, 3 Rolling mill
11, 12 Thickness gauge
13, 14 Speed meter
15 Control device
151 Entry thickness data transfer part
152 Thickness change amount calculation part
153 Target entry thickness calculation part
154 Entry thickness control part
16 Speed controller
21 Tension meter roll
22, 24 Pulse detector
23 Shape meter roll
Hc(N) Transferred thickness
Hd(N) Delivery thickness
Hd(N)_tgt Target delivery thickness
He(N) Entry thickness
He(N)_tgt Target entry thickness
ΔH(N) Amount of change in thickness
M Material to be rolled
S(N−2),S(N−1),S(N) Stand

The invention claimed is:

1. A control system of a tandem cold rolling mill comprising at least three or more stands in which a light reduction rolling is performed in a final stand of the at least three or more stands, comprising:

an entry thickness gauge configured to measure an entry thickness indicating a thickness of a material to be rolled in an entry side of the final stand;

a delivery thickness gauge configured to measure a delivery thickness indicating a thickness in a delivery side of the final stand; and a control device configured to execute thickness control of the material to be rolled by the at least three or more stands, wherein, in the thickness control, the control device is configured to:

based on entry speed indicating speed of the material to be rolled in the entry side of the final stand and delivery speed indicating the speed in the delivery side of the final stand, transfer the measured data of the entry thickness from an installation location of the entry thickness gauge to the installation location of the delivery thickness gauge at the same speed as speed of the material to be rolled;

based on the measured data of the delivery thickness and transfer data indicating the measured data of the entry thickness that is transferred to the installation location of the delivery thickness gauge at a timing when the said measured data of the delivery thickness is measured, calculate an amount of change in a thickness in the final stand;

based on the amount of change in the thickness and a target delivery thickness indicating a target value of the thickness in the delivery side of the final stand, calculate a target entry thickness indicating a target value of the thickness in the entry side of the final stand; and calculate a manipulated amount of the rolling speed of a stand located two or more stands upstream of the final stand such that the measured data of the entry thickness coincides with the target entry thickness.

2. The control system according to claim 1, further comprising:

an entry speed meter that is provided in the entry side of the final stand and is configured to measure the entry speed; and a delivery speed meter that is provided in the delivery side of the final stand and is configured to measure the delivery speed.

3. The control system according to claim 1, further comprising:

an entry roll that is a non-rolling roll installed in the entry side of the final stand;

an entry rotational speed meter configured to detect rotational speed of the entry roll;

a delivery roll that is the non-rolling roll installed in the delivery side of the final stand; and a delivery rotational speed meter configured to detect the rotational speed of the delivery roll, wherein, in the thickness control, the control device is configured to:

estimate the entry speed based on the rotational speed and a roll diameter of the entry roll; and estimate the delivery speed based on the rotational speed and the roll diameter of the delivery roll.

4. The control system according to claim 1, wherein, in the thickness control, the control device is configured to:

estimate the entry speed based on the rolling speed of a stand located one stand upstream of the final stand and a forward slip of the said stand; and estimate the delivery speed based on the rolling speed and the forward slip of the final stand.

5. The control system according to claim 1, wherein the control device is configured to calculate the amount of the change in the thickness based on a ratio obtained by dividing the transfer data by the measured data of the delivery thickness or a difference obtained by subtracting the measured data of the delivery thickness from the transfer data.

6. The control system according to claim 2, wherein the control device is configured to calculate the amount of the change in the thickness based on a ratio obtained by dividing the transfer data by the measured data of the delivery thickness or a difference obtained by subtracting the measured data of the delivery thickness from the transfer data.

7. The control system according to claim 3, wherein the control device is configured to calculate the amount of the change in the thickness based on a ratio obtained by dividing the transfer data by the measured data of the delivery thickness or a difference obtained by subtracting the measured data of the delivery thickness from the transfer data.

8. The control system according to claim 4, wherein the control device is configured to calculate the amount of the change in the thickness based on a ratio obtained by dividing the transfer data by the measured data of the delivery thickness or a difference obtained by subtracting the measured data of the delivery thickness from the transfer data.

* * * * *